US009247837B1

(12) United States Patent
Blake

(10) Patent No.: US 9,247,837 B1
(45) Date of Patent: Feb. 2, 2016

(54) ANTI-WRINKLE FOAM PILLOW SYSTEM

(71) Applicant: Brendon Blake, New York, NY (US)

(72) Inventor: Brendon Blake, New York, NY (US)

( * ) Notice: Subject to any disclaimer, the term of this patent is extended or adjusted under 35 U.S.C. 154(b) by 0 days.

(21) Appl. No.: 14/735,861

(22) Filed: Jun. 10, 2015

Related U.S. Application Data

(63) Continuation-in-part of application No. 13/603,741, filed on Sep. 5, 2012, now abandoned, which is a continuation-in-part of application No. 29/411,230, filed on Jan. 18, 2012, now Pat. No. Des. 669,725.

(51) Int. Cl.
*A47G 9/10* (2006.01)

(52) U.S. Cl.
CPC . *A47G 9/10* (2013.01); *A47G 9/109* (2013.01); *A47G 2009/1018* (2013.01)

(58) Field of Classification Search
CPC ... A47G 9/10; A47G 9/00; A47G 2009/1018; A47G 9/109; A47G 9/1036; A47G 9/1054; A47G 9/1081; A61G 7/07; A61G 7/072; A61G 7/1084; A61G 13/121; A61G 5/12; A61G 2005/121
See application file for complete search history.

(56) References Cited

U.S. PATENT DOCUMENTS

| | | | | | |
|---|---|---|---|---|---|
| D177,472 | S | * | 4/1956 | Huntington | D6/601 |
| 3,369,548 | A | * | 2/1968 | Moore et al. | 5/637 |
| 4,550,458 | A | * | 11/1985 | Fiore | 5/637 |
| D373,275 | S | * | 9/1996 | Bell et al. | D6/716.5 |
| 5,848,448 | A | * | 12/1998 | Boyd | 5/636 |
| 6,098,220 | A | * | 8/2000 | Momma | 5/636 |
| 6,289,538 | B1 | * | 9/2001 | Fidge | 5/640 |
| 6,629,324 | B1 | * | 10/2003 | Shapiro | 5/636 |
| 2005/0150051 | A1 | * | 7/2005 | Greenawalt et al. | 5/636 |

* cited by examiner

*Primary Examiner* — David E Sosnowski
*Assistant Examiner* — Amanda L Miller

(57) ABSTRACT

A back portion has a top edge and a bottom edge and side edges. The back portion has a forward surface and a rearward surface. A left side region and a right side region extend laterally from an associated side edge adjacent to the bottom edge. A perimeter is formed of the back portion and the left and right side regions. A left ear hole and a right ear hole are formed in the forward surface of the central region. A central recess is formed in the forward surface with a peripheral configuration following the perimeter of the back portion and the left and right side regions. The forward surface has a radially exterior extent and a radially interior extent. The radial interior extent is formed by the central recess. The entire radially exterior extent is in a plane parallel with the rearward surface.

1 Claim, 3 Drawing Sheets

FIG. 1
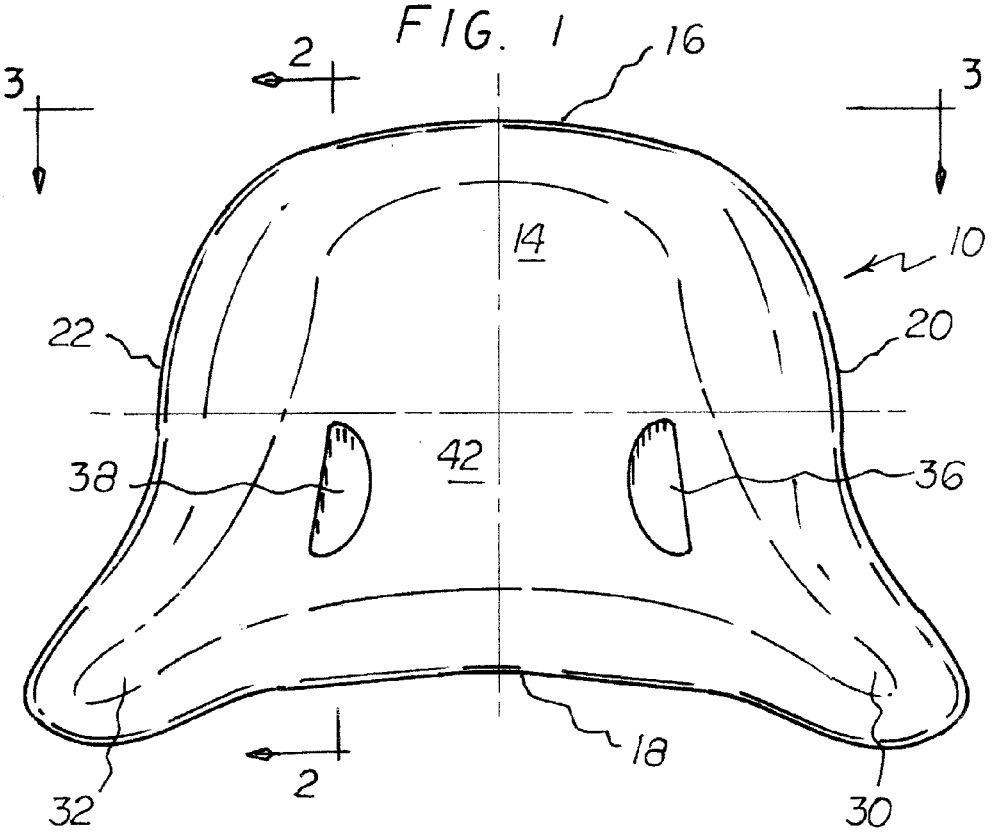
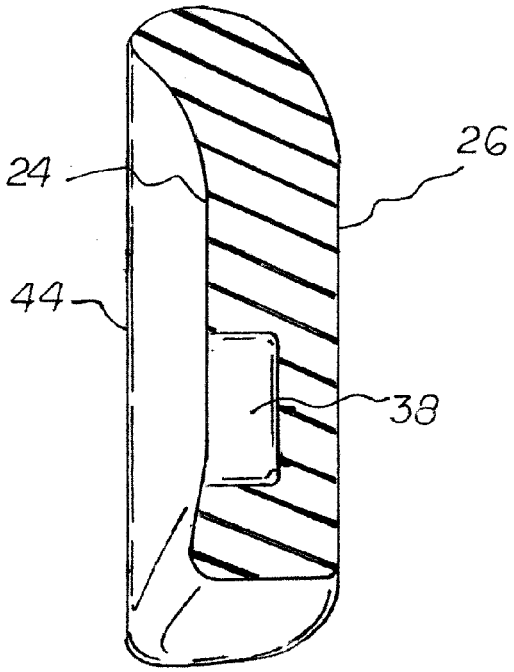
FIG. 2

FIG. 3
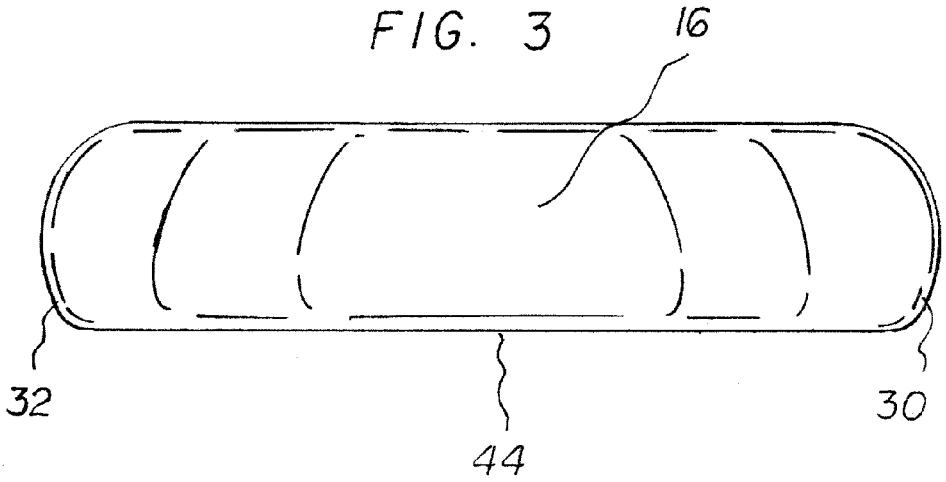
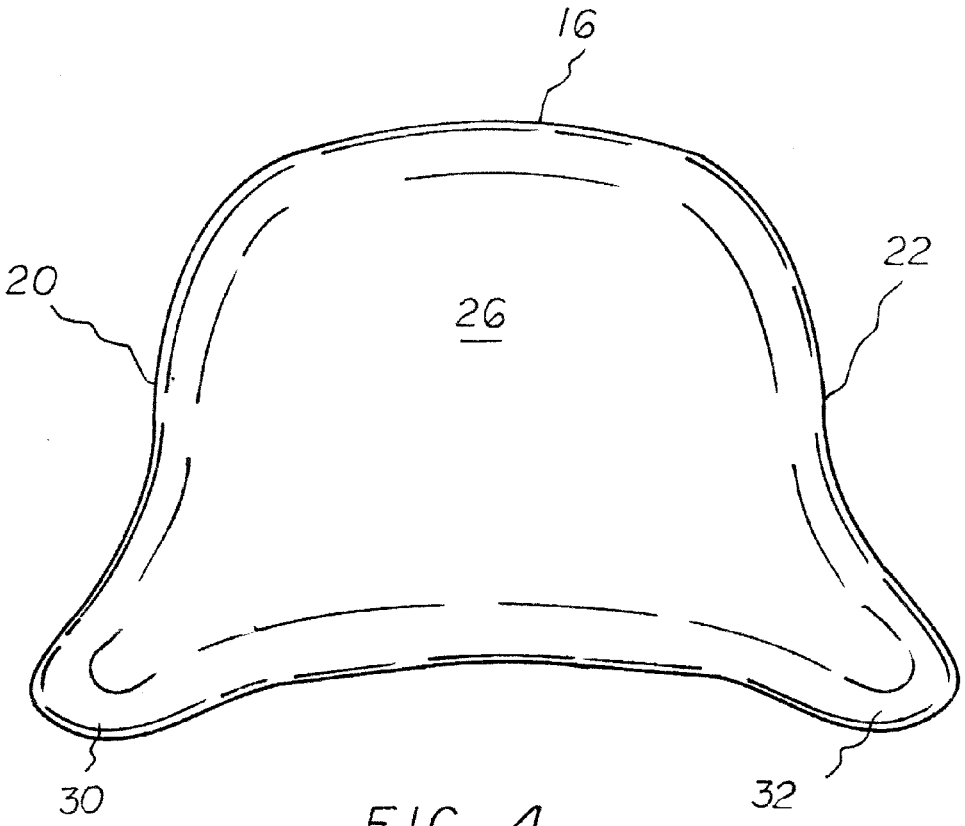
FIG. 4

ANTI-WRINKLE FOAM PILLOW SYSTEM

RELATED APPLICATION

The present non-provisional patent application is a continuation-in-part of pending application Ser. No. 13/603,741 filed Sep. 5, 2012 which in turn is a continuation-in-part of Design patent application Ser. No. 29/411,230 filed Jan. 18, 2012 which issued Oct. 30, 2012 as U.S. Pat. No. D669,725, the subject matter of which applications is incorporated herein by reference.

BACKGROUND OF THE INVENTION

Field of the Invention

The present invention relates to an anti-wrinkle foam pillow system and more particularly pertains to receiving the head of a side-resting user and for supporting the received side of the head in a comfortable manner to abate wrinkles, the receiving and supporting and the abating of wrinkles being done in a safe, sleep-inducing, convenient and economical manner.

SUMMARY OF THE INVENTION

In view of the disadvantages inherent in the known types of pillow systems of known designs and configurations now present in the prior art, the present invention provides an improved anti-wrinkle foam pillow system. As such, the general purpose of the present invention, which will be described subsequently in greater detail, is to provide a new and improved anti-wrinkle foam pillow system and method which has all the advantages of the prior art and none of the disadvantages.

To attain this, the present invention essentially comprises an anti-wrinkle foam pillow system. A back portion has top, bottom edges and side edges. The back portion has forward and rearward surfaces defining a back portion thickness. A vertical central plane is provided perpendicular to the forward and rearward surfaces midway between the side edges. A horizontal central plane is provided perpendicular to the vertical central plane midway between the top and bottom edges. Left and right side regions extend outwardly from the side edges adjacent to the bottom edge. A left ear hole is formed in the forward surface of the central region between the left side edge and the vertical central plane. A right ear hole is formed in the forward surface of the central region between the right side edge and the vertical central plane.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved anti-wrinkle foam pillow system which has all of the advantages of the prior art pillow systems of known designs and configurations and none of the disadvantages.

It is another object of the present invention to provide a new and improved anti-wrinkle foam pillow system which may be easily and efficiently manufactured and marketed.

It is further object of the present invention to provide a new and improved anti-wrinkle foam pillow system which is of durable and reliable constructions.

An even further object of the present invention is to provide a new and improved anti-wrinkle foam pillow system which is susceptible of a low cost of manufacture with regard to both materials and labor, and which accordingly is then susceptible of low prices of sale to the consuming public, thereby making such anti-wrinkle foam pillow system economically available to the buying public.

Even still another object of the present invention is to provide an anti-wrinkle foam pillow system for receiving the head of a side-resting user and for supporting the received side of the head in a comfortable manner to abate wrinkles. The receiving and supporting and the abating of wrinkles being done in a safe, sleep-inducing, convenient and economical manner.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a front elevational view of an anti-wrinkle foam pillow system constructed in accordance with the principles of the present invention.

FIG. 2 is a cross sectional view of the system taken along line 2-2 of FIG. 1.

FIG. 3 is a plan view of the system taken along line 2-2 of FIG. 1.

FIG. 4 is a rear elevational view of the system of the prior Figures.

The same reference numerals refer to the same parts throughout the various Figures.

DESCRIPTION OF THE PREFERRED EMBODIMENT

Figure 5:
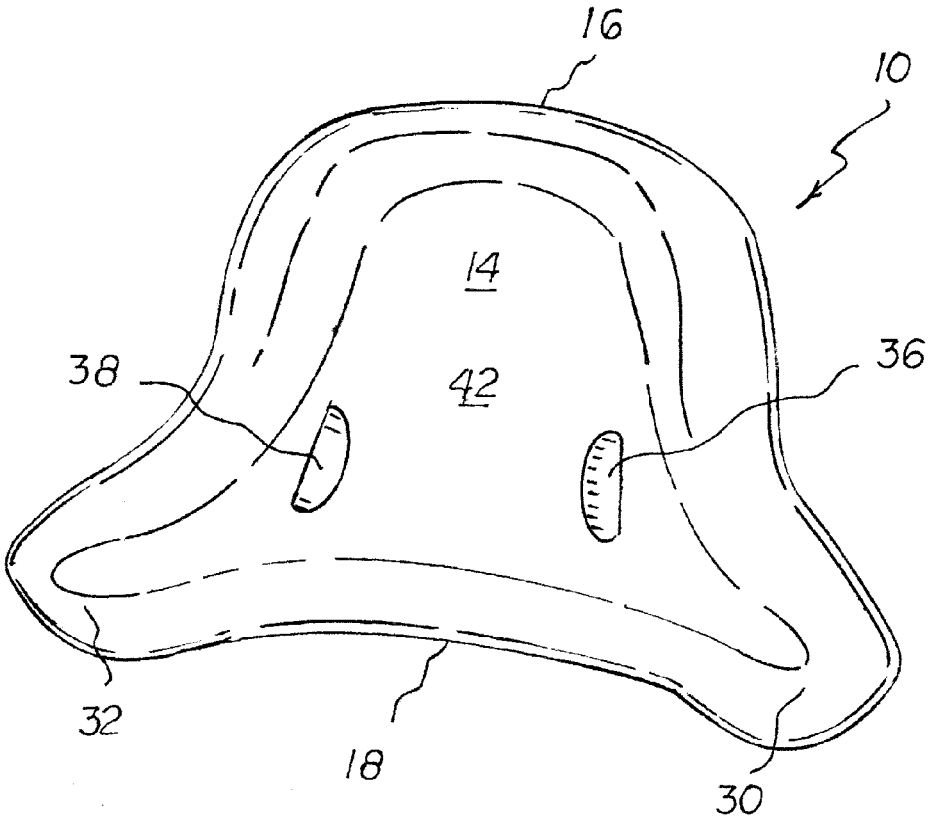
FIG. 5 is a perspective illustration of the system of the prior Figures.

With reference now to the drawings, and in particular to FIG. 1 thereof, the preferred embodiment of the new and improved anti-wrinkle foam pillow system embodying the principles and concepts of the present invention and generally designated by the reference numeral 10 will be described.

The present invention, the anti-wrinkle foam pillow system 10, is comprised of a plurality of components. Such components in their broadest context include a back portion, left and right side regions and left and right ear holes. Such components are individually configured and correlated with respect to each other so as to attain the desired objective.

First pillow system 10 for receiving the head of a side-resting user and for supporting the received side of the head in a comfortable manner to abate wrinkles. The receiving and the supporting and the abating of wrinkles is done in a safe, sleep-inducing, comfortable, and economical manner. The system includes a back portion 14 positionable in a generally vertical plane during use. The back portion has a generally trapezoidal configuration with a short top edge 16 and long bottom edge 18 and laterally tapering left and right side edges 20 22. The back portion has a forward surface 24 and a rearward surface 26 defining a back portion thickness between the forward and rearward surfaces over the majority of the extent of the back portion. The back portion has a vertical central plane perpendicular to the forward and rearward surfaces midway between the side edges. The back portion has a horizontal central plane perpendicular to the vertical central plane midway between the top edge and the bottom edges.

The back portion 16 has a central region 28 and a left side region 30 and a right side region 32. The left side region extends laterally from the left side edge of the central region adjacent to the bottom edge. The right side region extends laterally from the right side edge of the central region adjacent to the bottom edge.

The central region and the left side region and the right side region are integrally fabricated of a foam chosen from the class of foams including memory foam, a low-resilience/visco-elastic polyurethane foam, and latex and natural latex foam.

A left ear hole 36 is formed in the forward surface of the central region between the left side edge and the vertical central plane. The left ear hole has a center of curvature on the side of the left ear hole remote from the vertical central plane.

A right ear hole 38 is formed in the forward surface of the central region between the right side edge and the vertical central plane. The right ear hole has a center of curvature on the side of the right ear hole remote from the vertical central plane.

Each ear hole has a depth of between 40 percent and 60 percent of the back portion thickness adjacent to the ear holes. Each ear hole is semi-cylindrical in configuration with a maximum hole height of between 20 percent and 30 percent of the height of the central region and with a maximum hole width of between 40 percent and 60 percent of the hole height; and A central recess 42 is formed in the forward surface with a peripheral configuration following the perimeter of the back portion and the left side region and right side region. The forward surface 44 is radially exterior of central recess forming a forward plane parallel with the rearward surface.

In this manner face wrinkling and ear compression are abated when the user is side-resting with a left ear in the left ear hole and face contacting the central region and the right side region and when the user is side-resting with a right ear in the right hole and face contacting the back portion and the left side region.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An anti-wrinkle foam pillow system (10) for receiving the head of a side-resting user and for supporting the received side of the head in a comfortable manner to abate wrinkles, the receiving and the supporting and the abating of wrinkles being done in a safe, sleep-inducing, comfortable, and economical manner the system comprising, in combination:

a back portion (14) positionable in a generally vertical plane during use, the back portion having a generally trapezoidal configuration with a short top edge (16) and long bottom edge (18) and laterally tapering left and right side edges (20) (22), the back portion having a forward surface (24) and a rearward surface (26) defining a back portion thickness between the forward and rearward surfaces over the majority of the extent of the back portion, the back portion having a vertical central plane perpendicular to the forward and rearward surfaces midway between the side edges, the back portion having a horizontal central plane perpendicular to the vertical central plane midway between the top edge and the bottom edge;

the back portion (16) having a central region (28) a left side region (30) and a right side region (32), the left side region extending laterally from a left side edge of the central region adjacent to the bottom edge, the right side region extending laterally from a right side edge of the central region adjacent to the bottom edge;

the central region and the left side region and right side region being integrally fabricated of a foam chosen from the class of foams including memory foam, a low-resilience/visco-elastic polyurethane foam, and latex and natural latex foam;

a left ear hole (36) formed in the forward surface of the central region between the left side edge and the vertical central plane, the left ear hole having a center of curvature located on a side of the left ear hole remote from the vertical central plane; and a right ear hole (38) formed in the forward surface of the central region between the right side edge and the vertical central plane, the right ear hole having a center of curvature located on a side of the right ear hole remote from the vertical central plane;

each ear hole having a depth of between 40 percent and 60 percent of the back portion thickness adjacent to the ear holes, each ear hole being semi-cylindrical in configuration with a maximum hole height of between 20 percent and 30 percent of a height of the central region and with a maximum hole width of between 40 percent and 60 percent of the hole height; and a central recess (42) formed in the forward surface with a peripheral configuration following the perimeter of the back portion and the left side region and right side region, the forward surface (44) radially exterior of the central recess forming a forward plane parallel with the rearward surface;

whereby face wrinkling and ear compression are abated when the user is side-resting with a left ear in the left ear hole and face contacting the back portion and the right side region and when the user is side-resting with a right ear in the right hole and face contacting the back portion and the left side region.

* * * * *